United States Patent [19]

Ogle

[11] 3,975,725

[45] Aug. 17, 1976

[54] DISPLAY PANEL AND SYSTEM FOR OPERATING THE SAME

[75] Inventor: James A. Ogle, Neshanic Station, N.J.

[73] Assignee: Burroughs Corporation, Detroit, Mich.

[22] Filed: Nov. 29, 1974

[21] Appl. No.: 528,379

Related U.S. Application Data

[62] Division of Ser. No. 428,415, Dec. 26, 1973, Pat. No. 3,886,389.

[52] U.S. Cl. ..... 340/324 M; 315/169 TV; 340/343

[51] Int. Cl.[2] ..... G09F 9/32

[58] Field of Search ..... 340/324 M, 343, 173 PL; 315/169 TV

[56] References Cited

UNITED STATES PATENTS

| | | | |
|---|---|---|---|
| 3,683,364 | 8/1972 | Holz et al. | 340/324 M |
| 3,769,543 | 10/1973 | Pennebaker | 315/169 TV |
| 3,781,587 | 12/1973 | Lustig et al. | 315/169 TV |
| 3,863,090 | 1/1975 | Pennebaker, Jr. | 315/169 TV |
| 3,866,090 | 2/1975 | VanGelder et al. | 315/169 TV |

*Primary Examiner*—Marshall M. Curtis
*Attorney, Agent, or Firm*—Robert A. Green; William B. Penn

[57] ABSTRACT

The display panel includes a base plate which carries a plurality of pairs of scanning cathodes and display cathodes, oriented in columns, and insulating spacers which, in each pair, separate the scanning and display cathodes into operative pairs, with the pairs being arrayed in rows and columns. The panel also includes a face plate which carries a plurality of anode strips, oriented in rows, each strip overlaying and having a portion in operative relation with a row of scanning and display cathode pairs. In each pair of cathodes, only the display cathode is visible to a viewer. The face plate and base plate are sealed together to form an envelope which is filled with a gas suitable for supporting cathode glow.

In one mode of operation of the panel, each column of scanning cathodes is energized at a relatively low level, and then selected display cathodes in the associated column are energized at viewing level. Then, the same column of scan cathodes is re-energized, and glow is then transferred to the next adjacent column of scan cathodes where the cycle is repeated. This operation is carried out through the columns of scan and display cathodes in the panel sequentially at such a rate that a changeable but apparently stationary message is displayed by the total number of display cathodes energized.

2 Claims, 9 Drawing Figures

10
130
5
140
150
140
110
143
153
143
153
110
153
120
100
110
120
90
100
110
93
2
23
20
20A
80
50
60
70
70A
30
40KA
40KK
40
40R
40A
5
2

FIG. 2
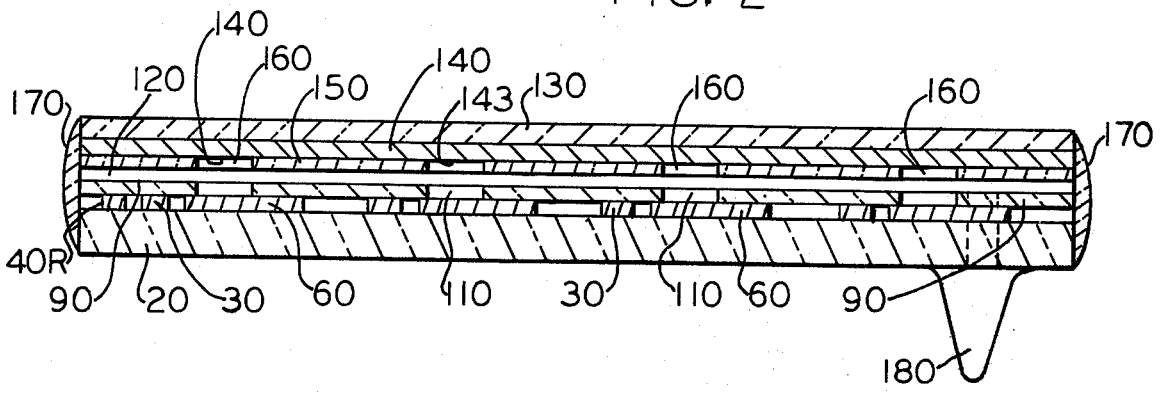
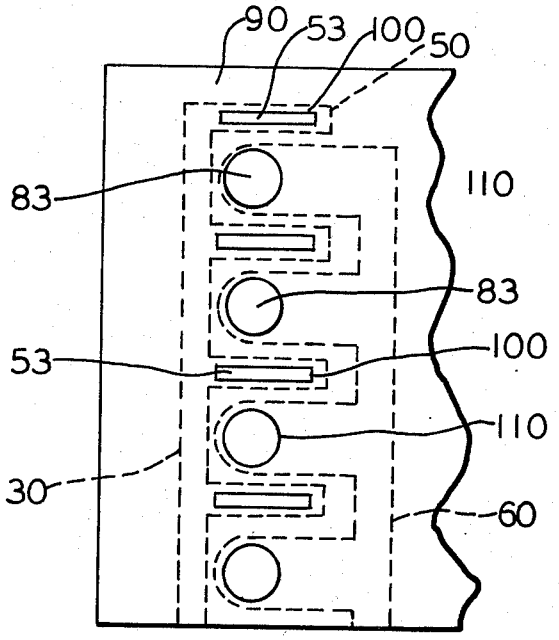
FIG. 3
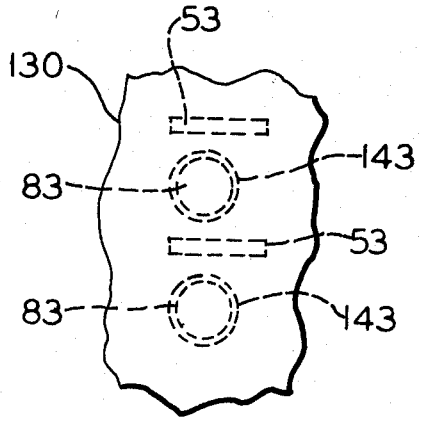
FIG. 4

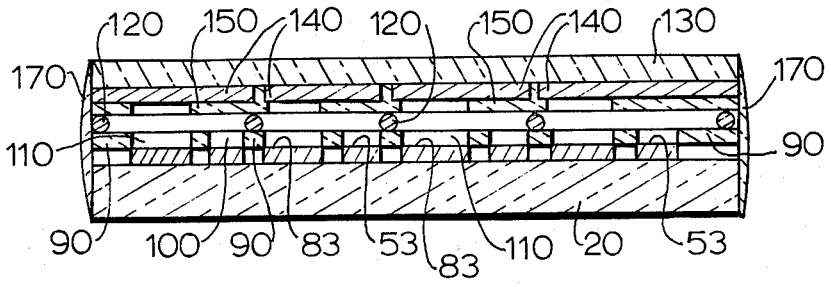
Fig. 5
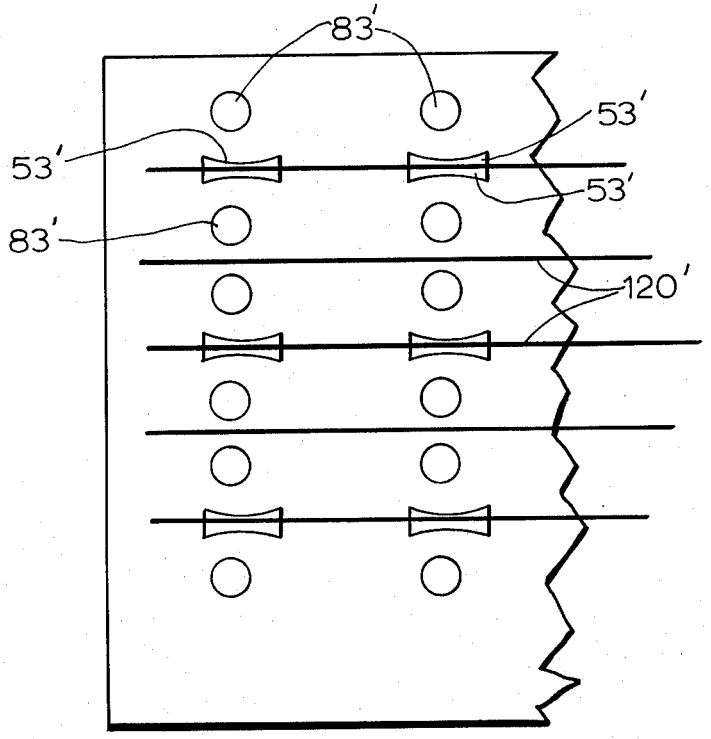
Fig. 8
Fig. 9
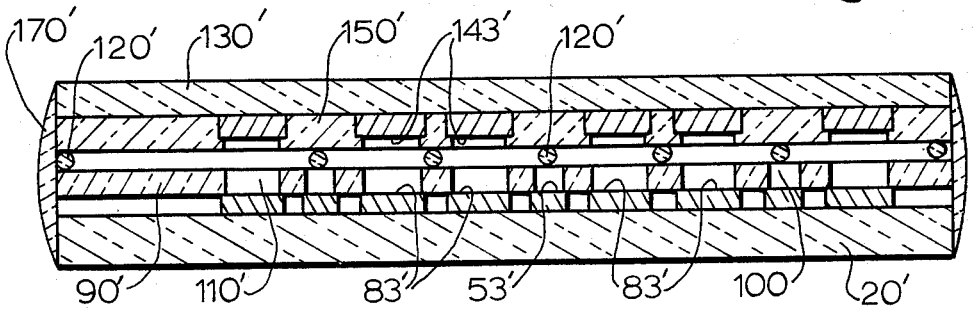

DISPLAY PANEL AND SYSTEM FOR OPERATING THE SAME

CROSS-REFERENCE TO RELATED APPLICATIONS

This application is a division of application Ser. No. 428,415, filed Dec. 26, 1973, now U.S. Pat. No. 3,886,389.

BACKGROUND OF THE INVENTION

One type of display panel presently available commercially is made by Burroughs Corporation and is known as a SELF-SCAN panel. This type of panel is a dot matrix device and includes a first layer of dot-like cells arrayed in rows and columns and adapted to be scanned column by column. The panel includes a second layer of display cells, each such cell being aligned with one of the cells of the first layer which are known as priming or scanning cells and adapted to have glow transferred thereto as the scanning cells are scanned in accordance with input information signals. These input signals control the pattern of display cells which are caused to glow to provide a display of a character or message.

This known type of panel operated satisfactorily; however, no matter how well a device operates, there is always a need for simplification in structure to provide economies in mass production. In addition, the above-described SELF-SCAN panel structure does not readily lend itself to the manufacture of large size pannels, for example, of the type known in the industry as wall displays.

SUMMARY OF THE INVENTION

Briefly, a display panel embodying the invention includes pairs of scanning and display cathodes disposed on a first plane and an anode electrode in operative relation with both cathodes, only the display cathode of each pair being visible to a viewer. The cathode pairs and their associated anodes are arrayed in rows and columns, and gas communication paths are provided along the various rows to simplify circuit operation of the panel.

DESCRIPTION OF THE DRAWINGS

FIG. 2 is a sectional view along the lines 2—2 in FIG. 1 showing the panel assembled;

FIG. 3 is a plan view of a portion of the panel of FIG. 2;

FIG. 4 is an enlarged plan view of two adjacent electrodes pairs of the panel of the invention;

FIG. 5 is a sectional view along the lines 5—5 in FIG. 1 showing the panel assembled;

FIG. 8 is a plan view of portions of the panel of FIG. 7; and

FIG. 9 is a sectional view along the lines 9—9 in FIG. 7.

DESCRIPTION OF THE PREFERRED EMBODIMENTS

Figure 1:
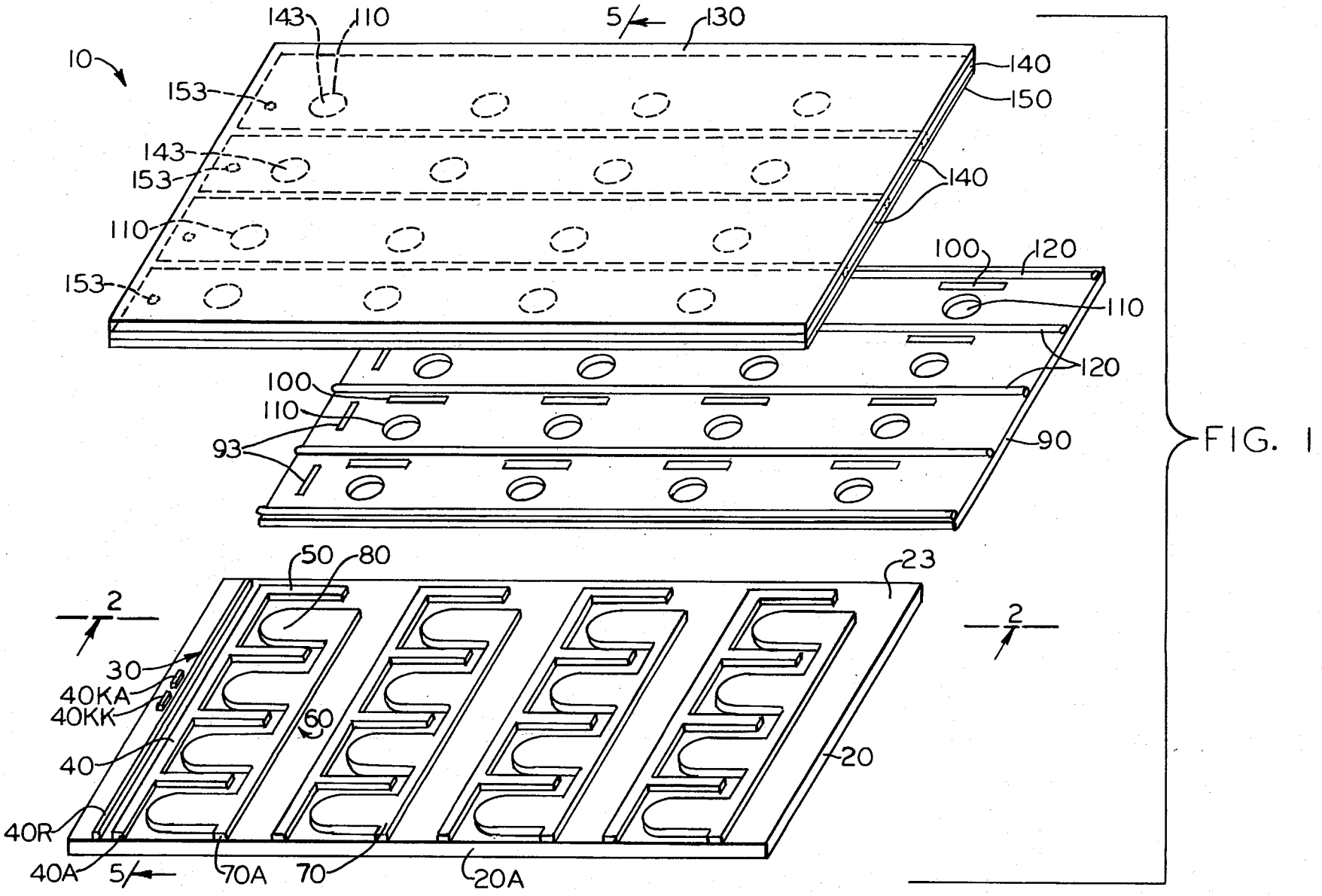
FIG. 1 is an exploded, perspective view of a display panel embodying the invention.

A display panel 10 embodying the invention (FIGS. 1 and 2) includes a base plate 20 of glass, ceramic, or the like having a top surface 23 on which are provided a plurality of cathode pairs. The cathode pairs include a first comb-like member 30 comprising an elongated lead portion 40 having a plurality of fingers 50 projecting therefrom toward the adjacent second member 60 which itself comprises an elongated lead portion 70 having a plurality of fingers 80 projecting therefrom and disposed between the fingers 50 of the first member 30. The fingers 50 of the first member 30 are narrower than the fingers 80 of the second member 60. The first and second cathode members 30 and 60 can be formed of individual metal strips, or they can be, and are preferably, formed by a silkscreen process using a powdered metal in a suitable carrier.

The panel 10 is to be used in a scanning mode of operation wherein the pairs of cathode members 30 and 60 are scanned sequentially, beginning at the left and continuing to the right, as seen in FIG. 1. Under some circumstances, it is desirable to provide means for insuring that the first cathode in the series 40A will turn on at the beginning of a scanning cycle, and this means comprises an auxiliary reset cathode electrode 40R in the form of a linear conductor positioned to the left of, but close to, cathode 40A.

It might also be desirable to provide a keep-alive cell comprising a small-area cathode 40KK and a small-area keep-alive anode 40KA formed on the top surface of plate 20 adjacent to cathode 40R and cathode 40A. The keep-alive cell is constantly energized and provides a source of excited particles for the other cells of the panel.

Reset cathode 40R and keep-alive electrodes 40KA and 40KK may also be formed by a silk-screen process.

A layer 90 of insulating material of glass or the like is formed over the cathodes by any suitable process, preferably a silk-screen process, and including a single elongated slot 93 or a plurality of short slots arranged in a column overlaying reset cathode 40R. Layer 90 also includes a plurality of columns of alternating narrow rectangular openings 100 and circular openings 110. Each narrow rectangular opening overlays and exposes a rectangular portion 53 (FIG. 3) of each finger 50, and each circular opening overlays and exposes a circular portion 83 of a finger 80. Rectangular electrode portions 53 comprise scanning cathodes, and circular electrode portions 83 comprise display cathodes.

The openings 50 and 80 and the exposed electrodes 53 and 83 are aligned in columns. A plurality of thin insulating rod spacers 120, of glass or the like, are disposed longitudinally on the insulating layer 90, and each is positioned between a rectangular aperture and a circular aperture so that they, in effect, isolate the columns of apertures into pairs, with each pair including a rectangular aperture and its electrode and a circular aperture and its electrode. It is noted that row-wise the pairs of rectangular and circular apertures and electrodes are in gas communication with each other. A spacer rod 120 is also provided along the upper and lower margins of layer 90. Under some circumstances, spacer rods 120 may provide sufficient isolation between rows of cells, in which case, insulating layer 90 may be omitted from the panel.

The panel 10 also includes a top glass cover plate 130, the bottom surface of which is provided with a plurality of separate strips 140 of transparent conductive material such as NESA, with each strip overlaying reset cathode 40R and a row of pairs of scanning cathodes 53 and display cathodes 83. A coating 150 of opaque insulating material is provided over the anode strips 140, with circular apertures 153 formed therein overlaying and aligned with aperture 93 which exposes reset cathode 40R. Coating 150 also includes circular apertures 160 formed in vertical alignment with each circular aperture 110 and display cathode 83 and of approximately the same diameter (FIG. 4). Each circular opening 110 exposes a circular portion 143 of the underlying anode strip, the portion 143 comprising the anode for the associated pair of scanning and display cathodes. The cover plate 130 is seated on the glass rod spacers 120 to provide suitable spacing between the anodes on the face plate and the cathodes supported on the base plate.

The base plate and face plate are hermetically sealed together along their adjacent edges by means of a seal 170 formed of a glass frit or the like, as is well known in the art. The panel 10 is filled with the desired gas such as neon, argon, or the like through a tubulation 180 secured to the base plate and aligned with a hole 190 in the base plate 20 and insulating layer 90. Mercury vapor is also included in the envelope to minimize cathode sputtering. The desired gas and the optimum pressure therefor can be readily determined by those skilled in the art. It is known that firing potential, gas pressure and electrode spacing are related, and those skilled in the art can select the desired gas pressure from this relationship. In the present invention, gas pressures in the range of 100 to 300 Torr are suitable.

It is noted that each open circular anode area 143 overlays and is in operative relation with a display cathode 83; however, it is also in operative relation with the associated scanning cathode 53 (FIG. 5), and a volume of gas fills the space in which these electrodes are located. The scanning cathode 53 and the associated anode 143 comprise a scanning, or priming, cell, and the display cathode 83 and the associated anode 143 comprise a display cell.

To make electrical connections to panel 10, contact terminals are secured in any suitable fashion to the portions 40 of cathodes 30 and portions 70 of cathodes 60, preferably the portions 40A and 70A thereof which are positioned at the lower edge 20A of base plate 20 (FIG. 1). Connection is made in similar fashion to one of the ends of the anode strips 140. Alternatively, the base plate and face plate may be suitably dimensioned to permit contact members to be inserted between them to make the desired electrical connection to the various panel electrodes. The latter type of connection is employed with PANAPLEX II display panels, which are presently offered for sale by Burroughs Corporation and are shown in copending application Ser. No. 201,655, filed Nov. 24, 1971.

Figure 6:
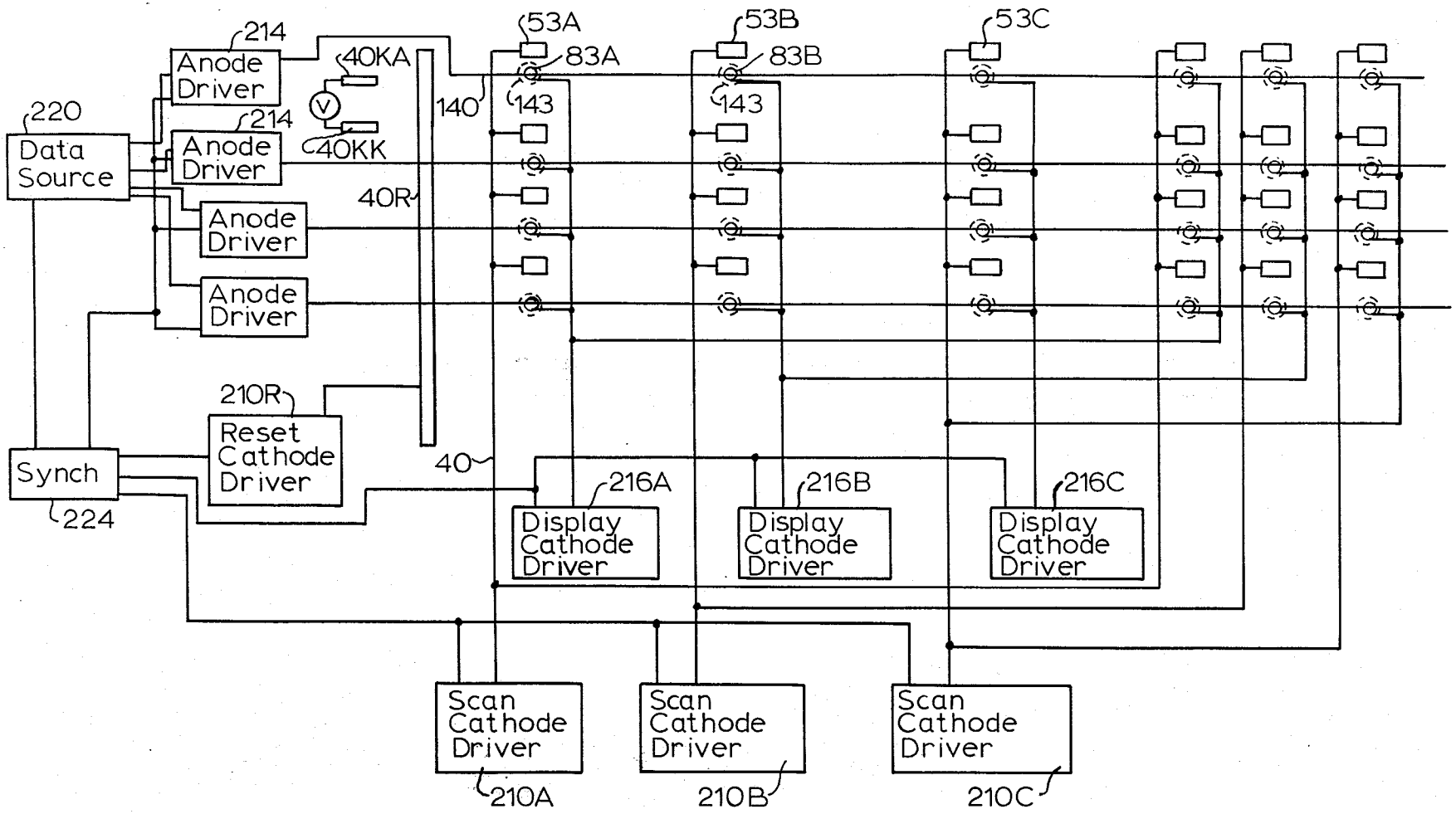
FIG. 6 is a schematic representation of the panel of the invention and a circuit in which it may be operated.

The display panel 10 may be operated in several different ways; however, basically, the panel utilizes principles of operation of the type employed in SELF-SCAN panels, which are made and sold by Burroughs Corporation. One mode of operation is described with reference to FIG. 6, which is a schematic representation of panel 10 and a circuit in which it may be operated. Essentially, operation of the panel comprises scanning and turning on the columns of scanning, or priming, cells 53 sequentially and continually throughout the panel by connecting the scan cathode conductors 40 to drivers or switches 210. The keep-alive anode 40KA and keep-alive cathode 40KK are connected to a source of potential V, and they are held ON constantly to provide a steady source of excited particles. The reset cathode 40R is connected to a driver or switch 210R, and the scan cathode conductors 40 are connected in three groups, with every fourth such conductor being connected to a driver or switch 210. The three drivers are designated by reference numerals 210A, B, and C. The display cathodes are similarly connected in three groups, and their conductors 70 are coupled to cathode drivers or switches 216A, B, and C. In addition, an anode driver 214, which operates as a current source, is coupled to each anode 140, and a source of data signals 220 is connected to each anode driver. Data source 220 represents an array of information-handling apparatus including, as required, a computer, encoders, decoders, character generators and the like apparatus, as is well known in the art. The circuit also includes suitable clock or synchronizing circuits 224 coupled to the data source 220, to the anode drives 214, and to the cathode drivers 210 and 216 for synchronizing the operation in a manner described below.

Briefly, operation of the panel 10 comprises, turning on the reset cells formed by cathode 40R and the anodes, by the application of operating potentials and causing current flow therebetween, and then the columns of scanning cells 53 are turned on sequentially throughout the panel by the turn-on of each scan cathode driver 210, in turn, and by the simultaneous turn-on of all of the anode drivers 214. As each column of scanning cathodes and scanning cells is energized, the associated column of display cathodes and display cells is energized, and, by applying the proper potential to selected anodes as determined by the input information signals, and generating corresponding current flow, the associated selected display cathodes can be made to glow. This glow is visible to a viewer, and, as the columns of scanning cells are continually scanned throughout the panel, and selected associated display cells are turned on at suitable current level, an apparently stationary but changeable message is displayed by the selected display cells.

More specifically, in operation of panel 10, with the keep-alive cell energized and generating excited particles, the reset cathode driver 210R is switched on and the anode drivers 214 are energized to cause current flow between the reset cathode and the anodes and to cause cathode glow to appear along the reset cathode 40R. Thus, excited particles are generated therey and are available for the scanning cycle which is initiated by the turn-off of the reset cathode driver 210R and the turn-on of scan cathode driver 210A, with the anodes still energized. Current flows between the first column of scan cathodes 53 and the anodes, and the first column of scanning cells is energized, with the applied potentials being adjusted so that the scanning cells are turned on at a low level of excitation and current flow.

It is noted that, although the scan cathode driver 210A is connected to other columns of scan cathodes, because of their remoteness from the excited particles generated by the reset cathode, they do not turn on; the first scan cathode turns on preferentially because of its closeness to the reset cathode, the source of excited particles.

Next, the first display cathode driver 216A is turned on to cause current flow between the first column of display cathodes 83A and the anodes, and simultaneously, signals from data source 220 coupled to selected anode drivers 214 cause suitably higher currents to flow to the selected anodes 140, from their associated display cathodes, and the display cathodes 83A associated with such selected anodes glow at a favorable visible level.

Next, display cathode driver 216A is turned off and scan cathode driver 210A is turned on again, and, at the same time, all of the anodes 140 are energized at a low level so that a low level of current flows to all of the first scan cathodes 53A, and they are thus re-energized and they again generate excited particles.

It is noted that the display cathodes selected by the data signals are turned on for a relatively short period of time of the order of 100 microseconds to insure that excited particles, which had been generated by the scan cathodes when they were first turned on, are present in sufficient supply to permit all of the scan cathodes to be turned on again.

The foregoing operation is repeated for each column of scan cathodes and display cathodes continually and sequentially through the panel at such a rate that display cells which are selected and turned on in each column; in accordance with the signals from data source 220, display an apparently stationary but changeable message in all of the selected display cells.

Figure 7:
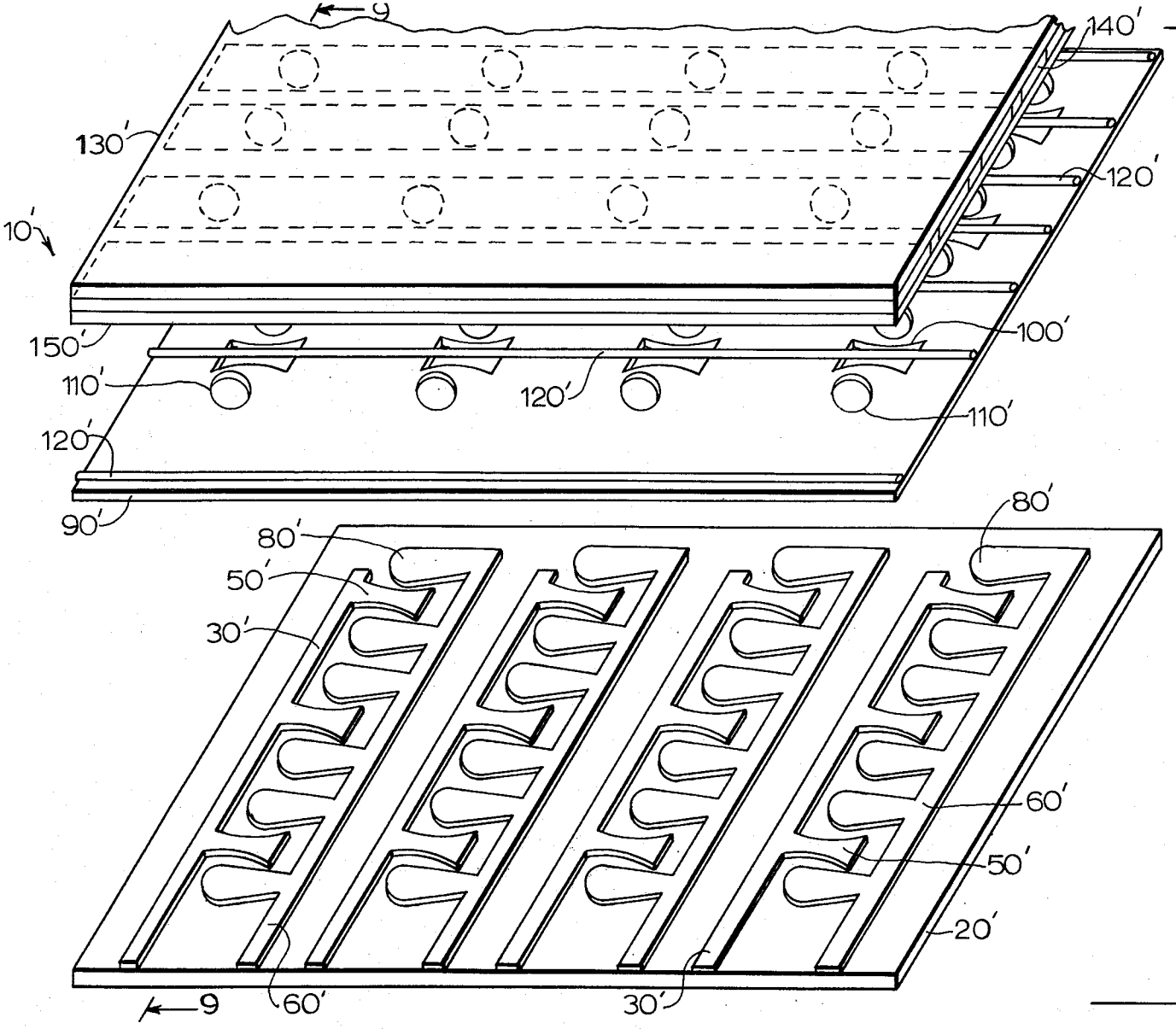
FIG. 7 is an exploded, perpspective view of a display panel embodying modifications in the invention.

In another embodiment of the invention (FIGS. 7, 8, and 9), a display panel 10' includes base plate 20' and a pattern of screened cathode electrode pairs, each including scan cathode member 30' and display cathode member 60' which are generally similar to corresponding cathodes 30 and 60 of panel 10. In this case, each scan cathode finger 50' is disposed between its own pair of display cathode fingers 80'. The panel 10' includes an insulating layer 90' formed on the base plate 20' and having circular apertures 110' overlaying fingers 80' and relatively wide, generally dumbbell or rectangular shape apertures 100' overlaying fingers 50'. Apertures 100' and 110' are aligned in columns, and it can be seen that each aperture and the scan cathode 53' it exposes is disposed between a pair of circular apertures 110' and display cathodes 83' exposed thereby. Glass rod spacers 120' are seated on insulating layer 90' overlaying the openings 100' and so positioned that they separate each such opening and the associated scan cathodes 53 into two portions, one associated with the display anode 143 above it in the column, and the other associated with the display cell below it in the column. In addition, a spacer rod 120' is disposed between the adjacent circular opening 110' which are not separated by an opening 100'.

Panel 10' also includes face plate 130 which carries on its lower surface, anode strips 140' covered with an opaque layer 150' having circular openings 160' overlaying display cathodes 83'.

Thus, it can be seen, as illustrated in FIGS. 8 and 9, that each column of cells includes a scanning cell made up of an anode 143' and a scanning cathode 53', and a display cell made up of the same anode 143' and a display cathode 83'. As shown, each scanning cathode 53' operates with two adjacent anodes 143' to form adjacent scanning cells.

The operation of panel 10' is essentially the same as panel 10 except that each scan cathode 53' operates with two display cathodes 83' to provide economy in device and circuit structures.

The display panel of the invention has many advantages which derive from its relative simplicity of construction. Since the panel includes only two electrodesupport plates, and all of the cells are disposed in a single layer; it is clear that the constructions is relatively simple and economical. In addition, since the panel includes only a single layer of cells, individual panels can be made in larger size than the SELF-SCAN panels described above. Also, a composite "wall-size" panel may be made by butting together the individual panels.

What is claimed is:

1. The method of operating a display panel which comprises a gas-filled envelope having a viewing window and including a plurality of coplanar cathode pairs arrayed in rows and columns, each pair of cathodes including a scan cathode and a display cathode, the cathode glow generated by a display cathode being adapted to be viewed through said viewing window and the cathode glow generated by a scanning cathode being adapted to provide excited particles to expedite the generation of cathode glow by the associated display cathode, all of the scan cathodes in a column being electrically connected and all of the display cathodes in a column being electrically connected, there thus being a plurality of columns of scan cathodes each having an associated column of display cathodes, there thus being a first column of scan cathodes and a first associated column of display cathodes, a last column of scan cathodes and a last column of display cathodes, and intermediate columns of scan cathodes each having an associated column of display cathodes, there also being a plurality of rows of cathode pairs, each such cathode pair including a scan cathode and a display cathode, and a row anode overlying and in operative relation with each row of cathode pairs, there thus being one anode for each row of cathode pairs, said method comprising energizing all of said row anodes and said first column of scan cathodes in a circuit to produce scan cathode glow in all of the scan cathodes of said first column, energizing selected ones of said row anodes and the first column of display cathodes in a circuit to produce display cathode glow in the display cathodes associated with said selected row anodes, and substantially simultaneously de-energizing said first column of scan cathodes, re-energizing said first column of scan cathodes and substantially simultaneously de-energizing said selected display cathodes, and repeating said series of steps for all of said columns of scan cathodes and display cathodes sequentially and repetitively throughout said panel at such a rate that an apparently stationary but changeable message is displayed by all of the selected display cathodes.

2. A display panel and system for operating it comprising a gas-filled envelope having a viewing window, a plurality of coplanar cathode pairs arrayed in rows and columns, each pair including a scan cathode and a display cathode, the cathode glow generated by a display cathode being adapted to be viewed through said viewing window and the cathode glow generated by a scanning cathode being adapted to provide excited particles to expedite the generation of cathode glow by the associated display cathode, all of the scan cathodes in a column being electrically connected and all of the display cathodes in a column being electrically connected, there thus being a plurality of columns of scan cathodes each having an associated column of display cathodes, there also being a plurality of rows of cathode pairs, each such cathode pair including a scan cathode and a display cathode, a row anode overlying and in operative relation with each row of cathode pairs, there thus being one anode for each row of cathode pairs, first circuit means coupled to all of said anode electrodes and to each of said columns of scan cathodes for scanning said columns of scan cathodes sequentially and repetitively in a column-bycolumn scan, one after another, beginning with the first column and continuing through the columns to the last column, with all of the scan cathodes in each column, in turn, exhibiting cathode glow and generating excited particles, and second circuit means coupled between said anodes and each of said columns of display cathodes for energizing and generating cathode glow in selected display cathodes in each column of display cathodes as the associated column of scan cathodes is caused to exhibit cathode glow, the glow of the display cathodes thus selectively energized in each column thereof combining to represent a character, said first circuit means also including means for de-energizing each column of scan cathodes when its associated column of display cathodes is energized and re-energizing each column of scan cathodes after its associated column of display cathodes has been energized.

* * * * *